US006255028B1

(12) United States Patent
Hasegawa et al.

(10) Patent No.: US 6,255,028 B1
(45) Date of Patent: Jul. 3, 2001

(54) ELECTROPHOTOGRAPHIC TONER AND IMAGE FORMING METHOD USING THE TONER

(75) Inventors: Kumi Hasegawa; Shinichi Kuramoto; Hiroshi Yamashita, all of Shizuoka-ken; Masato Igarashi, Ibaraki-ken; Nobutaka Kinoshita; Kohsuke Suzuki, both of Shizuoka-ken, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/494,658

(22) Filed: Jan. 31, 2000

(30) Foreign Application Priority Data

Jan. 29, 1999 (JP) ..... 11-022142

(51) Int. Cl.[7] ..... G03G 9/087
(52) U.S. Cl. ..... 430/109; 430/120
(58) Field of Search ..... 430/106, 109, 430/110, 120

(56) References Cited

U.S. PATENT DOCUMENTS 5,310,812 * 5/1994 Yasuda et al. ..... 525/309
5,368,972 11/1994 Yamashita et al. ..... 430/137
5,427,883 * 6/1995 Misawa et al. ..... 430/109
5,565,298 10/1996 Suguro et al. ..... 430/137
5,683,847 11/1997 Patel et al. ..... 430/137

FOREIGN PATENT DOCUMENTS 0 427 273 5/1991 (EP) .
0 575 891 12/1993 (EP) .
8-27552 3/1996 (JP) .

OTHER PUBLICATIONS

Patent Abstracts of Japan, vol. 12, No. 43 (P–664), Feb. 9, 1988, JP 62–191858, Aug. 22, 1987.

Database WPI, AN 1990–250063, JP 02–173759, Jul. 5, 1990.

* cited by examiner

*Primary Examiner*—John Goodrow
(74) *Attorney, Agent, or Firm*—Oblon, Spivak, McClelland, Maier & Neustadt, P.C.

(57) ABSTRACT

An electrophotographic toner including a colorant and a binder resin including at least a styrene resin, wherein the toner further includes one or more styrene oligomers in an amount not greater than 100 ppm. An electrophotographic image forming method is also disclosed in which an electrostatic latent image formed on an image bearing member is developed with the toner.

22 Claims, 1 Drawing Sheet

ELECTROPHOTOGRAPHIC TONER AND IMAGE FORMING METHOD USING THE TONER

BACKGROUND OF THE INVENTION

1. Field of the Invention

The present invention relates to a toner useful for developing an electrostatic latent image formed on an image bearing member, and to an electrophotographic image forming method in which an electrostatic latent image formed on an image bearing member is developed using a toner to form a visual image.

2. Discussion of the Background

Inorganic photoconductive materials such as selenium, zinc oxide, cadmium sulfide and selenium alloys have been developed and used for an electrophotographic photoconductor. In recent year, organic photoconductive materials (OPC) are mainly used for a photoconductor because the materials have the following advantages:

(1) having a relatively low cost;

(2) being easily processed;

(3) capable of producing images having good image qualities; and (4) being environmentally friendly even when disposed of.

However, the disadvantage of the OPC photoconductors against inorganic photoconductors is that the properties of the photoconductors are easily influenced by environmental changes in image forming apparatus because the charge transporting layer (CTL) of the OPC photoconductors is mainly constituted of an organic polymer. One of the environmental changes is generation of acidic gases such as ozone and NOx, which is caused by a main charger for charging the photoconductor, and a transfer charger. When OPC photoconductors are exposed to such acidic gases, decomposition of a charge transporting material (CTM) included in the CTL occurs at the surface of the CTL. Therefore the resultant images tend to be blurred. In addition, charge quantities of the OPC photoconductor are often decreased by the acidic gases depending on the charge generating material (CGM) used in the charge generating layer (CGL), thereby causing background fouling and deterioration of image density of the resultant mages. Further, there occurs a contamination problem in that the toner, which remains on a surface of an OPC photoconductor even after the photoconductor is cleaned, contaminates the OPC. Namely, when an OPC photoconductor contacts the toner, which is electrostatically adhered on the developing sleeve or the toner remaining on the surface of the photoconductor, for a long time under a high temperature condition, the toner contaminates the OPC photoconductor, resulting in increase of the residual potential of the OPC photoconductor, and thereby blurring and tailing occur in the resultant images. Since the copying speed of electrophotographic image forming apparatus now increases more and more, it is very important to solve these problems.

In addition, Japanese Patent Publication No. 8-27552 discloses a toner including a composition of a styrene copolymer (B) which includes a styrene-including oligomer (A) having a number average molecular weight not greater than 1000 in an amount of from 0.01 to 1% by weight. Namely, the toner includes the styrene-including oligomer in an amount of from 100 ppm to 10000 ppm. However, when processes, in which an OPC photoconductor is developed with such a toner and the resultant toner images are transferred, are repeated for a long time, the OPC photoconductor is contaminated with the toner. In particular, the residual potential of the OPC photoconductor increases seriously, resulting in occurrence of background fouling and blurring in the resultant images. The reason is considered to be that the oligomer migrates into the OPC photoconductor and traps charges, resulting in prevention of transporting of the charges, and thereby the resultant image has image defects.

Because of these reasons, a need exists for an electrophotographic toner for developing latent images formed on an OPC photoconductor, which produces images without image defects caused by contamination of the OPC photoconductor even when the toner is used for a long time even under a relatively high temperature condition.

SUMMARY OF THE INVENTION

Accordingly, an object of the present invention is to provide a toner which produces images without image defects caused by contamination of the OPC photoconductor even when the toner is used for a long time even under a relatively high temperature condition.

Another object of the present invention is to provide an electrophotographic image forming method by which images without image defects caused by contamination of the OPC photoconductor can be produced even when processes of development and transferring are repeated for a long time under a relatively high temperature even under a relatively high temperature condition.

Briefly these objects and other objects of the present invention as hereinafter will become more readily apparent can be attained by a toner which includes a colorant and a binder resin including at least a styrene resin, wherein the toner includes one or more styrene oligomers in an amount of not greater than 100 ppm.

The content of styrene oligomers is preferably from 0.1 to 90 ppm, more preferably from 1 to 60 ppm, even more preferably from 5 to 50 ppm, and most preferably from 10 to 30 ppm.

The binder resin preferably includes styrene-acryl copolymer.

Another aspect of the present invention is to provide an electrophotographic image forming method including the steps of forming an electrostatic latent image on an OPC photoconductor and developing the latent image by a toner, wherein the toner includes a colorant and a binder resin including at least a styrene resin, and wherein the toner includes one or more styrene oligomers in an amount of not greater than 100 ppm.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein.

DETAILED DESCRIPTION OF THE INVENTION

Figure 1:
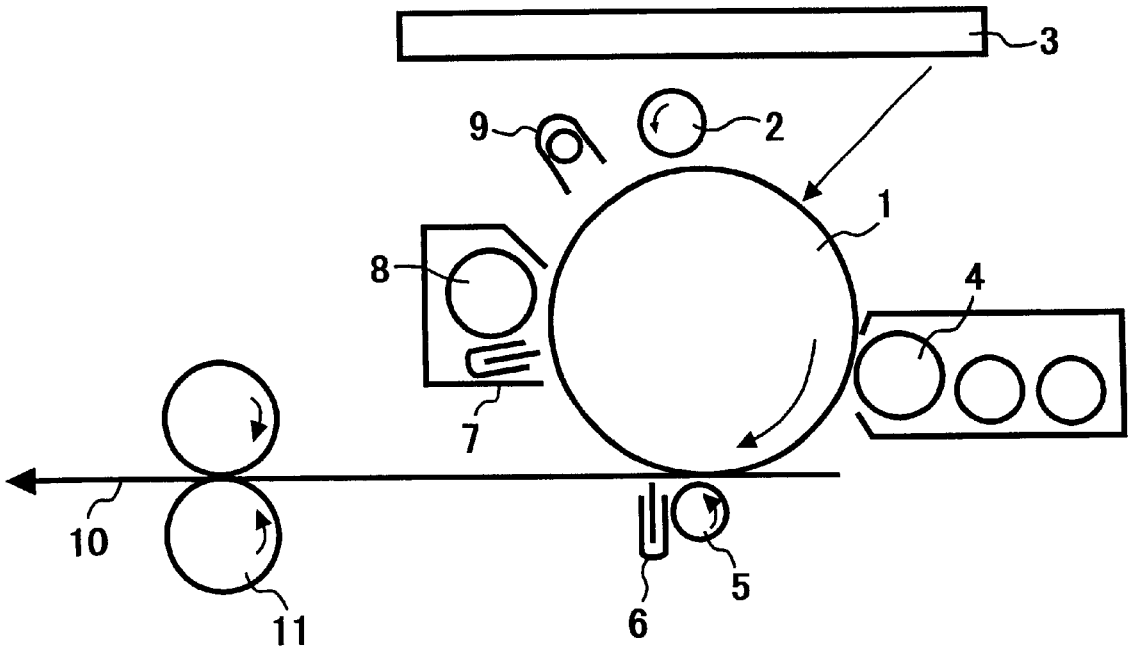
FIG. 1 is a schematic view illustrating a cross section of an image forming apparatus useful for the image forming method of the present invention.

Generally, the present invention provides a toner which is used for developing electrostatic latent image formed on an OPC photoconductor to form toner images and which includes a colorant and a binder resin including at least a styrene resin, wherein the toner includes one or more styrene oligomers in an amount of not greater than 100 ppm.

The present inventors analyze the mechanism of occurrence of the image defects caused by contamination of the OPC photoconductor used for bearing latent images when the image forming processes are repeated for a long time under a relatively high temperature condition (from about 30 to about 50° C.), and discover the following facts.

OPC photoconductors generally have a structure in which a photoconductive layer including a charge generating layer (CGL) and a charge transporting layer (CTL) is formed on an electroconductive substrate. A charge generating material (CGM) is included in the CGL. The CGM absorbs irradiated light and positive and negative charge carriers are formed.

The one type (positive or negative) of the carriers is injected into the CTL and the other type (negative or positive) is injected into the electroconductive substrate, which is caused by an electric field applied to the photoconductive layer. The carrier injected into the CTL is transported through the CTL by the electric field and finally reaches to the surface of the CTL. At the surface of the CTL, charges formed thereon are decayed by the transported carrier. In order that the OPC photoconductor exerts good photoconductive properties, the photoconductor has to effectively generate carriers by absorbing light. In addition, the carriers have to be rapidly transported through the photoconductive layer without being trapped. When the OPC contacts a toner including a material having a double bond and $\pi$ electron donating properties, the OPC is contaminated with the toner, resulting in trapping of carrier (holes) in the CTL. Therefore the surface charges cannot be decayed and a relatively large residual potential remains on the OPC. The present inventors discover that among the materials having $\pi$ electron donating properties, the OPC is most seriously affected by styrene oligomers. The reason is considered to be that styrene oligomers have most strong electron donating properties because double bonds are formed in the every other carbon bonding in the molecule of styrene oligomers. Therefore holes are easily trapped by styrene oligomers.

In the present invention, styrene oligomer means polymerized styrene having a relatively low polymerization degree in which 2 to 20 styrene monomers are polymerized. Styrene monomer is not included in styrene oligomers. Styrene monomer has a low boiling point, and therefore it vaporizes when left at a relatively high temperature of from 30 to 50° C. Therefore it is considered that styrene monomer does not contaminate OPCs. In contrast, styrene oligomers do not vaporize at a temperature of from 30 to 50° C., and in addition they have a greater affinity for OPCs. Therefore styrene oligomers are considered to contaminate OPCs.

The less the content of styrene oligomers in a toner, the less the contamination. When the content of styrene oligomers in a toner is not greater than 100 ppm, the toner hardly contaminates OPC photoconductors. When styrene oligomers are present in a toner in a proper amount of from 0.1 ppm to 90 ppm, the OPC, which contacts the toner, is plasticized by the styrene oligomers migrating into the OPC and therefore the OPC becomes to have flexibility. Therefore the OPC has good resistance to abrasion. In particular, the content of styrene oligomers in the toner is preferably from 1 ppm to 60 ppm, more preferably from 5 ppm to 50 ppm, and even more preferably from 10 ppm to 30 ppm.

By using a binder resin, which includes styrene oligomers in an amount of not greater than 100 ppm, for a toner, the resultant toner includes styrene oligomers in an amount of not greater than 100 ppm.

In order to prepare a resin including styrene oligomers in an amount of not greater than 100 ppm, it is preferable that the polymerization of the resin is performed at a relatively high temperature for a long time. When a suspension polymerization method is used, the polymerization is preferably performed at a temperature of from 70 to 100° C. for 5 to 20 hours in the viewpoint of economy and the content of styrene oligomers in the resultant resin.

In addition, the content of styrene oligomers in the toner of the present invention can also be controlled in the preferable range by controlling the kneading temperature in the kneading process of the toner so as to be relatively high. In specifically, when the kneading is performed at a temperature of from 100 to 200° C., the toner composition can be sufficiently dispersed in the kneading process.

The content of styrene oligomers in a toner can be determined by gas chromatography mass spectrometry (GC1MS method) using an apparatus QP-5000 manufactured by Shimazu Corp. The measuring conditions are as follows:

Ion source: EI 70 eV

Detector: Cylindrical fourfold pole with a brirod and off-axis secondary electron multiplier Column: DB-5 (length of 30 m, inside diameter of 0.25 mm, and a film of 0.25 $\mu$m)

Column temp.: From 50 to 300° C. (hold of 1 min.) The column temperature is increased at a speed of 10° C./min.

Vaporization room temp.: 350° C.

Column pressure (He): From 100 to 150 kPa (hold of 1 min.) At a pressure increasing speed of 2 kPa/min.

The image forming method of the present invention will be explained referring to FIG. 1.

FIG. 1 is a schematic view illustrating a cross section of an image forming apparatus useful for the image forming method of the present invention. Around an image bearing member 1 (i.e., an OPC), a charging device 2, a laser radiating device 3, a developing roller 4, a transfer roller 5, a separating charger 6, a cleaning unit 7, a cleaning device 8, and a discharging lamp 9 are provided. Specific examples of the charging device 2 include corona chargers, charging brushes, charging rollers and the like. Specific examples of the cleaning device 8 include cleaning brushes, cleaning rollers and the like.

The image forming process will be explained referring to a nega-posi process.

The image bearing member, which is an OPC having an organic photoconductive layer, is discharged by the discharging lamp 9 and then uniformly charged so as to have a potential, for example, −700 V (from about −100 to about −1000 V) by the charging device 2. The laser radiating device 3 irradiates the image bearing member with laser light to form a latent image thereon. The area of the image bearing member which is exposed to laser light has a potential of about −100 V.

Laser light is radiated by a laser diode, and reflected by a polygon (hexagon) mirror, which rotates at a high speed, to scan the surface of the image bearing member in the rotating direction of the image bearing member. Thus, an electrostatic latent image is formed on the image bearing member.

The latent image is then developed by a magnetic brush of the developing roller 4, which holds a toner thereon, while a voltage of, for example, −550 V (from about −100 to about −800 V) is applied thereto. The toner adhered on the area of the image bearing member, which has been exposed to laser light, resulting in formation of a toner image on the image bearing member.

On the other hand, a receiving paper 10 serving as a receiving material is fed from a paper feeding mechanism (not shown). The receiving paper 10 is fed between the image bearing member 1 and the transfer roller 5 after being timed to the image bearing member by a pair of registration roller (not shown) such that the toner image are properly transferred onto the receiving paper 10. Thus the toner images are transferred onto the receiving paper 10. At this point, the transfer roller 5 is applied by a transfer bias of, for example, +950 V (from about +100 to +1000 V). When toner image transferring is performed using a corona charger, a voltage of from about 1 kV to about 10 kv is applied to the charger. The toner images on the receiving paper 10 are fixed by a fixing device 11 after the receiving paper 10 is separated from the image bearing member 1. The receiving paper 10 having a fixed toner image thereon (i.e., a copy) is discharged out of the apparatus. The feeding speed of the receiving paper 10 is from about 50 to 1000 mm/sec.

In the present invention, a charging roller is used for charging the image bearing member. By using a charging roller, the image bearing member can be charged by a relatively low voltage, and therefore damages of the image bearing member can be decreased.

Next, the OPC of the present invention will be explained in detail.

Suitable electroconductive substrates include cylinders and films made of a metal such as aluminum, and stainless steel: a metal alloy such as aluminum alloys, and indium oxide-tin oxide alloys; a paper and a plastic including an electroconductive material therein; and a plastic including an electroconductive polymer.

In the present invention, an undercoat layer can be formed on the electroconductive substrate in order to:

(1) improve adhesion of the photoconductive layer to be formed thereon to the substrate;

(2) improve coating properties (i.e., film forming properties) of the photoconductive layer;

(3) protect the substrate;

(4) cover defects on the surface of the substrate;

(5) improve charge injection from the substrate; and (6) prevent the photoconductive layer from being electrically damaged when the photoconductor is charged.

Suitable materials for use in the undercoat layer include polyvinyl alcohol, poly-N-vinyl imidazole, polyethylene oxide, ethyl cellulose, methyl cellulose, nitrocellulose, ethylene-acrylic acid copolymer, polyvinyl butyral, phenolic resins, casein, polyamides, nylon copolymers, glue, gelatin, polyurethane, aluminum oxide, etc.

The thickness of the undercoat layer is preferably from 0.1 $\mu$m to 10 $\mu$m, and more preferably from 0.1 $\mu$m to 3 $\mu$m.

The photoconductive layer includes a charge generating layer and a charge transporting layer.

The charge generating layer includes one or more charge generating materials. Specific examples of the charge generating materials include organic materials such as azo pigments, phthalocyanine pigments, indigo pigments, perylene pigments, polycyclic quinone pigments, squarilium dyes, pyrylium salts, thiopyrylium salts, and triphenyl methane dyes; and inorganic materials such as selenium and amorphous silicon. The charge generating layer can be formed by coating a coating liquid, in which one or more of these charge generating materials are dispersed in a binder resin, or by depositing one or more of these materials by a vapor deposition method. Suitable binder resins for use in the charge generating layer include polycarbonate resins, polyester resins, polyvinyl butyral resins, polystyrene resins, acrylic resins, methacrylic resins, phenolic resins, silicone resins, epoxy resins, vinyl acetate resins and the like. The content of the binder resin in the charge generating layer is preferably not greater than 80% by weight, and more preferably from 0 to 40% by weight. The thickness of the charge generating layer is preferably not greater than 5 $\mu$m, and more preferably from 0.05 $\mu$m to 2 $\mu$m.

The charge transporting layer receives charge carriers from the charge generating layer in the presence of electric field, and then transports the carriers. The charge transporting layer can be formed by coating a liquid in which one or more charge transporting materials are dissolved in a solvent optionally together with a binder resin. The thickness of the charge transporting layer is generally from 5 $\mu$m to 40 $\mu$m. Suitable charge transporting materials for use in the charge transporting layer include polycyclic aromatic compounds including in their main chain or side chain a structure such as biphenylene, anthracene, pyrene, and phenathrene; heterocyclic compounds including a nitrogen atom such as indole, carbazole, oxadiazole, and pyrazoline; hydrazone compounds, and styryl compounds; and inorganic compounds such as selenium, selenium-tellurium, amorphous silicon, and cadmium sulfide.

Suitable binder resins for use in the charge transporting layer include resins such as polycarbonate resins, polyester resins, polymethacrylate resins, polystyrene resins, acrylic resins, and polyamide resins; and organic electroconductive polymers such as poly-N-vinyl carbazole, and polyvinylanthrathene.

A protective layer may be formed on the photoconductive layer. The protective layer mainly includes a resin such as polyesters resins, polycarbonate resins, acrylic resins, epoxy resins, phenolic resins, and mixtures of these resins with a crosslinking agent. These resins can be used alone or in combination.

The toner of the present invention includes any known styrene type resin as a binder resin. Specific examples of such styrene resin include homopolymers of styrene or substitution products of styrene such as polystyrene, poly-p-styrene, and polyvinyl toluene; and styrene copolymers such as styrene-p-chlorostyrene copolymers, styrene-propylene copolymers, styrene-vinyl toluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-methyl $\alpha$-chloromethacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic acid copolymers, and styrene-maleic acid ester copolymers.

In the toner of the present invention, a polyester resin is preferably used together with the styrene resin to broaden the fixable temperature range of the toner.

Suitable polyester resins for use in the toner of the present invention include polyester resins prepared by condensation-polymerizing an alcohol component with a carboxylic acid component.

Specific examples of the alcohol component include diols such as ethylene glycol, diethylene glycol, triethylene glycol, 1,2-propylene glycol, 1,3-propylene glycol, 1,4-butanediol, neopentyl glycol, and 1,4-butenediol; and dihydric alcohol monomers such as 1,4-bis (hydroxymethyl) cyclohexane, bisphenol A, hydrogenated bisphenol A and other dihydric alcohol monomers.

Specific examples of the carboxylic acid components include maleic acid, fumaric acid,. mesaconic acid, citraconic acid, itaconic acid, gultaconic acid, phthalic acid, isophthalic acid, terephthalic acid, cyclohexanedicarboxylic acid, succinic acid, adipic acid, sebacic acid, malonic acid, and their acid anhydrides and low alkyl esters, dimer of linolenic acid and other dibasic organic acid monomers.

In the polyester resins for use in the present invention, one or more alcohol component and carboxylic acid components, which have three or more functional groups, are included as well as the monomers having two functional groups mentioned above.

Specific examples of the carboxylic acid components and their acid anhydrides, which have three or more functional groups, include 1,2,4-benzentricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxyl propane, tetra (methylenecarboxyl)methane, 1,2,7,8-octanetetracarboxylic acid, trimer acids of embole, and their acid anhydrides, and the like.

Specific examples of the alcohol components having three or more functional groups for use in the polyester resins include glycerin, 1,1,1-trimethylol ethane, 1,1,1-trimethylol propane, 1,1,1-trimethylol butane, pentaerythritol, 1,1,2,2-tetramethylol ethane, 1,1,3,3-tetramethylol propane, sorbitol, and polyvinyl alcohol.

The polyester resins for use in the present invention can be manufactured by any known esterification reaction method. In addition, any known ester interchanging reaction method can also be used for preparing the polyester resins for use in the present invention. In the ester interchanging reaction, a known catalyst may be used. Specific examples of such a catalyst include magnesium acetate, zinc acetate, manganese acetate, calcium acetate, tin acetate, lead acetate, titanium tetrabutoxide and the like.

The polyester resins for use in the present invention can be manufactured by any known condensation polymerization method. When condensation polymerization is performed, a known polymerization catalyst such as antimony trioxide and germanium dioxide can be used.

The toner of the present invention may include a magnetic powder, a charge controlling agent and other additives in addition to the one or more resins mentioned above, and one or more colorants and/or magnetic powders.

Specific examples of the colorant include known pigments and dyes such as carbon black, iron oxides, Phthalocyanine Blue, Phthalocyanine Green, Rhodamine 6G Lake, and Watchung Red strontium. The content of the colorant in the toner is preferably from 1 to 60% by weight.

Suitable charge controlling agents for use in the toner of the present invention include Nigrosine dyes, fatty-acid-modified Nigrosine dyes, metal-including Nigrosine dyes, fatty-acid-modified Nigrosine dyes including a metal, chromium complexes of 3,5-di-t-butylsalicylic acid and the like. The preferable content of the charge controlling agent in the toner of the present invention is generally from 0 to 20%.

Suitable releasing agents for use in the toner of the present invention include waxes having a melting point of from 70 to 170° C. Specific examples of the waxes include carnauba wax, montan waxes, sazol waxes, paraffin waxes, low-molecular-weight polyethylene, low-molecular-weight polypropylene, ethylene-vinyl acetate copolymers and the like. The preferable content of the releasing agent in the toner of the present invention is from 1 to 10% by weight.

Specific examples of the other additives include silica powders, hydrophobic silica powders, polyolefins, paraffin waxes, fluorocarbon compounds, fatty acid esters, partially-saponified fatty acid esters, fatty acid metal salts and the like. These materials are used in an amount of from 0.1 to 5% by weight.

The toner of the present invention can be used as a dry one-component developer or a dry two-component developer. When used as a one-component developer, the toner includes a particulate magnetic material such as metal alloys or metal compounds including iron, cobalt or nickel, such as ferrites, and magnetites; and alloys, which do not include a ferromagnetic element but exhibit ferromagnetic properties when subjected to a proper heat treatment, such as Heusler's alloys including Mn and Co, e.g., Mn—Co—Al and Mn—Co—Sn, and chromium dioxide. In the one-component developer of the present invention, it is preferable that a fine powder of the magnetic material having an average particle diameter of from 0.3 to 30$\mu$m is uniformly dispersed in a binder resin. The content of the magnetic material in the toner (i.e., developer) is from 20 to 70% by weight, and more preferably from 40 to 70% by weight.

The toner of the present invention for use as a two-component developer mainly includes a binder resin, a colorant and a charge controlling agent, as mentioned above. The toner is mixed with a carrier mentioned below to prepare a two-component developer.

The toner of the present invention can be manufactured by any known mixing method and pulverizing method. For example, all components are mixed in a predetermined ratio, kneaded well while heating the components, and then cooled. The mixture is pulverized and then classified to prepare a toner. Alternatively, a toner can be prepared by mixing a colorant, a resin and a solvent in a ball mill, and then spray-drying the mixture.

When the toner of the present invention is used for cascade developing methods, magnetic brush developing methods and O-shell developing methods, the toner preferably has a weight average particle diameter not greater than about 30 $\mu$m, and more preferably from about 4 to about 20 $\mu$m. When the toner is used for powder cloud developing methods, the toner preferably has a weight average particle diameter slightly less than 1 $\mu$m.

Known coated carriers and non-coated carriers for use in cascade developing methods, magnetic brush developing methods and O-shell developing methods can be used in the present invention. However, in the present invention the carrier is not limited thereto, and any materials, which have a charge opposite to the toner of the present invention when the toner particles closely contact the surface of the carrier particles while surrounding the carrier particles, can also be used as a carrier. The toner of the present invention is used as a two-component developer by being mixed with such a carrier, to develop electrostatic latent images formed on a photoconductor.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Binder Resin

The following components were contained into a flask of 3 litter in volume, which had a condenser, a stirrer, a gas blowing tube and a thermometer.

| | |
|---|---|
| Deionized water | 1500 g |
| Styrene monomer | 500 g |
| n-butyl methacrylate monomer | 200 g |
| Divinyl benzene monomer | 7.0 g |
| Benzoyl peroxide | 20 g |
| Dodecylbenzene sulfonic acid sodium salt | 10 g |

The mixture was heated to a predetermined reaction temperature while stirring, to perform a reaction. The prepared reaction product was washed with water, and then dried under a pressure of 10 torr.

The reaction conditions were as follows:

Reaction time: 12 hours

Reaction temperature: 90° C.

Reaction atmosphere: $N_2$

The formulation of the binder resin and the reaction conditions are also described in Table 1.

Thus, a binder resin powder A-1 included volatile materials not greater than 1%. The content of styrene oligomers in the binder resin was 70 ppm.

Preparation of Toner

The following components were mixed.

| | |
|---|---|
| Binder resin A-1 | 100 |
| Carnauba wax | 5 |
| Carbon black | 10 |
| Metal-complex type dye | 2 |

The mixture was melt and kneaded using a two-roll mill. The mixture was then cooled and pulverized to prepare a toner of Example 1 (T-1). The kneading conditions are described in Table 2.

Preparation of Developer

One hundred (100) parts of magnetite was mixed with 2 parts of toner T-1 using a TURBULA mixer. Thus a developer was prepared.

Evaluation Method of Developer (Toner)

The developer was set in a copier, modified SUPIRIO 7000 manufactured by Ricoh Co., Ltd., and a running test was performed in which an original image having an image rate of 7% was reproduced 100,000 times.

When charging the photoconductor of the copier (sometimes referred to as photoconductor charging), a charging method (C) in which a voltage of −5 kV was applied by a corona charger or another charging method (R) in which charging was performed by a charging roller to which an AC voltage of 400 V was applied was used. In addition, when transferring the toner images, a charging method (C') in which a voltage of+3 kV was applied by a corona charger or another charging method (R') in which charging was performed by a charging roller to which an DC voltage of+300 V was applied was used for transferring the toner images.

The charging methods using a roller are preferable because damages of the photoconductor are less than the case in which a corona (wire) charger is used as a charging device.

Images reproduced after the running test was evaluated with respect to the following image qualities:

(1) Blurring

A line image, which was reproduced so as to have a density of 600 dpi (dots per inch), was observed by a microscope to determine whether blurring occurred. Blurring was classified into 5 grades by comparing the line image with five standard samples of rank 1 (bad) to rank 5 (excellent).

(2) Tailing

A reproduced character image was visually observed to determine whether the character image tailed. Tailing was classified into 5 grades by comparing the character image with five standard samples of rank 1 to rank 5.

(3) Background Fouling

A white image (i.e., a copy having no image thereon) was reproduced, and the optical image density of the side of the copy, which contacted the photoconductor, was measured with a Macbeth reflection densitometer.

The results are shown in Table 2.

Examples 2 to 7 and Comparative Examples 1 to 5

The procedure for preparation of the binder resin in Example 1 was repeated except that the formulation and the reaction conditions were changed as described in Table 1.

In addition, the procedures for preparation of the toner and the evaluation method in Example 1 were repeated except that the toner preparation conditions and image forming conditions were changed as described in Table 2.

The results are also shown in Table 3.

TABLE 1

| | Example | | | | | Comparative Example | | |
|---|---|---|---|---|---|---|---|---|
| | 1 | 2 | 3 | 4 | 5 | 1 | 2 | 3 |
| ST | 500 g | 500 g | 500 g | 500 g | 500 g | 500 g | 500 g | 500 g |
| n-BMA | 200 g | 200 g | 200 g | 200 g | 200 g | 200 g | 200 g | 200 g |
| DVB | 7.0 g | 5.0 g | 7.0 g | 7.0 g | 7.0 g | 5.0 g | 6.0 g | 6.0 g |
| BPO | 20 g | 18 g | 20 g | 20 g | 20 g | 18 g | 15 g | 15 g |
| Water | 1500 g | 1500 g | 1500 g | 1500 g | 1500 g | 1500 g | 1500 g | 1500 g |
| DBS | 10 g | 10 g | 10 g | 10 g | 10 g | 10 g | 10 g | 10 g |
| Reaction | 12 | 12 | 12 | 12 | 18 | 10 | 7 | 25 |

TABLE 1-continued

| | Example | | | | | Comparative Example | | |
|---|---|---|---|---|---|---|---|---|
| | 1 | 2 | 3 | 4 | 5 | 1 | 2 | 3 |
| time (hr) | | | | | | | | |
| Reaction Temp. (° C.) | 90 | 90 | 95 | 100 | 100 | 80 | 90 | 100 |
| Reaction atm. | $N_2$ | $N_2$ | $N_2$ | $N_2$ | $N_2$ | $N_2$ | $N_2$ | $N_2$ |
| ST. oligomer in binder resin (ppm) | 70 | 100 | 45 | 23 | 0.5 | 280 | 350 | 0 |

ST: styrenemonomer, n-BMA: n-butylmethacrylatemonomer, DVB: divinyl benzene monomer, BPO: benzoyl peroxide, Water: deionized water, DBS: dodecylbenzene sulfonic acid sodium salt

TABLE 2

| | | Kneading conditions | | Content of styrene oligomers and styrene monomer in toner | | Charging device | |
|---|---|---|---|---|---|---|---|
| | Binder resin | Kneading time (min) | Kneading temp. (° C.) | ST oligomers (ppm) | ST monomer (ppm) | Photoconductor charging | Transfer charging |
| Ex. 1 | A-1 | 30 | 140 | 62 | 220 | C | C' |
| Ex. 2 | A-3 | 30 | 140 | 42 | 160 | C | C' |
| Ex. 3 | A-4 | 30 | 140 | 18 | 180 | C | C' |
| Ex. 4 | A-5 | 30 | 140 | 0.4 | 32 | C | C' |
| Ex. 5 | A-2 | 30 | 140 | 98 | 72 | C | C' |
| Ex. 6 | A-2 | 20 | 140 | 85 | 324 | R | C' |
| Ex. 7 | A-1 | 35 | 145 | 53 | 160 | C | R' |
| Comp. Ex. 1 | B-1 | 30 | 140 | 206 | 138 | C | C' |
| Comp. Ex. 2 | B-2 | 30 | 140 | 311 | 69 | C | C' |
| Comp. Ex. 3 | B-3 | 30 | 140 | 0 | 25 | C | C' |
| Comp. Ex. 4 | B-1 | 20 | 140 | 260 | 82 | R | C' |
| Comp. Ex. 5 | B-2 | 35 | 145 | 150 | 99 | R | R' |

C: Charging method using a corona charger
R: Charging method using a roller
C': Charging method using a corona charger
R': Charging method using a roller

TABLE 3

| | Image qualities | | |
|---|---|---|---|
| | Blurring (rank) | Tailing (rank) | Background fouling |
| Ex. 1 | 3 | 3 | 0.03 |
| Ex. 2 | 4 | 4 | 0.02 |

TABLE 3-continued

| | Image qualities | | |
|---|---|---|---|
| | Blurring (rank) | Tailing (rank) | Background fouling |
| Ex. 3 | 5 | 4 | 0.01 |
| Ex. 4 | 2 | 3 | 0.05 |

TABLE 3-continued

| | Image qualities | | |
|---|---|---|---|
| | Blurring (rank) | Tailing (rank) | Background fouling |
| Ex. 5 | 3 | 2 | 0.08 |
| Ex. 6 | 4 | 5 | 0.06 |
| Ex. 7 | 5 | 5 | 0.03 |
| Comp. Ex. 1 | 1 | 1 | 0.25 |
| Comp. Ex. 2 | 1 | 1 | 0.19 |
| Comp. Ex. 3 | 2 | 1 | 0.15 |
| Comp. Ex. 4 | 2 | 3 | 0.12 |
| Comp. Ex. 5 | 3 | 2 | 0.14 |

As can be understood from Tables 1 to 3, the toners and the image forming methods of the present invention can produce good images when used for a long time. In particular, the toners and the image forming methods of Examples 3 and 7 can produce excellent images.

This document claims priority and contains subject matter related to Japanese Patent Application No. 11-022142, filed on Jan. 29, 1999, incorporated herein by reference.

Having now fully described the invention, it will be apparent to one of ordinary skill in the art that many changes and modifications can be made thereto without departing from the spirit and scope of the invention as set forth therein.

What is claimed is:

1. An electrophotographic toner, comprising:

a colorant; and a binder resin; wherein said binder resin comprises at least one styrene resin; and wherein said toner comprises not more than 100 ppm of a styrene oligomer.

2. The electrophotographic toner according to claim 1, wherein said styrene oligomer is a polymerized styrene in which 2 to 20 styrene monomers are polymerized.

3. The electrophotographic toner according to claim 1, wherein said styrene oligomer does not vaporize at a temperature of 30 to 50° C.

4. The electrophotographic toner according to claim 1, wherein said styrene oligomer is present in said toner in an amount of 0.1 to not greater than 100 ppm.

5. The electrophotographic toner according to claim 1, wherein said styrene oligomer is present in said toner in an amount of 0.1 to 90 ppm.

6. The electrophotographic toner according to claim 1, wherein said styrene oligomer is present in said toner in an amount of 10 to 30 ppm.

7. The electrophotographic toner according to claim 1, wherein said binder resin comprises said styrene oligomer in an amount not greater than 100 ppm.

8. The electrophotographic toner according to claim 1, wherein said binder resin comprises a styrene-acrylic copolymer.

9. The electrophotographic toner according to claim 1, wherein said styrene resin is a resin selected from the group consisting of polystyrene, poly-p-styrene, polyvinyl toluene, styrene-p-chlorostyrene copolymer, styrene-propylene copolymer, styrene-vinyl toluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic acid copolymer, and styrene-maleic acid ester copolymer.

10. The electrophotographic toner according to claim 1, wherein said binder resin further comprises a polyester resin.

11. The electrophotographic toner according to claim 1, further comprising at least one selected from the group consisting of magnetic powder, charge controlling agent, releasing agent, and additive, and combinations thereof.

12. A one-component developer, comprising the electrophotographic toner according to claim 1 and a particulate magnetic material.

13. A two-component developer, comprising the electrophotographic toner according to claim 1 and a carrier.

14. An electrophotographic image forming method, comprising:

forming an electrostatic latent image on an image bearing member; and developing said latent image with a toner, to form a toner image; wherein said toner comprises:

a colorant; and a binder resin; wherein said binder resin comprises at least one styrene resin; and wherein said toner comprises not more than 100 ppm of a styrene oligomer.

15. The method according to claim 14, wherein said styrene oligomer is a polymerized styrene in which 2 to 20 styrene monomers are polymerized.

16. The method according to claim 14, wherein said styrene resin is a resin selected from the group consisting of polystyrene, poly-p-styrene, polyvinyl toluene, styrene-p-chlorostyrene copolymer, styrene-propylene copolymer, styrene-vinyl toluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic acid copolymer, and styrene-maleic acid ester copolymer.

17. The method according to claim 14, wherein said binder resin further comprises a polyester resin.

18. The method according to claim 14, further comprising electrostatically transferring said toner image onto an image receiving material by contacting said image bearing member with a transfer charging device, said image receiving material being therebetween, and applying a voltage to said image bearing member.

19. An electrophotographic image forming method, comprising:

contacting and charging an image bearing member with a charging device;

exposing said image bearing member to imagewise light, to form a latent image on said image bearing member;

developing said latent image with a toner, to form a toner image on said image bearing member; wherein said toner comprises:

a colorant; and a binder resin; wherein said binder resin comprises at least one styrene resin; and wherein said toner comprises not more than 100 ppm of a styrene oligomer.

20. The method according to claim 19, wherein said styrene oligomer is a polymerized styrene in which 2 to 20 styrene monomers are polymerized.

21. The method according to claim 19, wherein said styrene resin is a resin selected from the group consisting of polystyrene, poly-p-styrene, polyvinyl toluene, styrene-p-chlorostyrene copolymer, styrene-propylene copolymer, styrene-vinyl toluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-methyl a-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic acid copolymer, and styrene-maleic acid ester copolymer.

22. The method according to claim 19, wherein said binder resin further comprises a polyester resin.

* * * * *